US009126728B1

(12) United States Patent
Elston et al.

(10) Patent No.: US 9,126,728 B1
(45) Date of Patent: Sep. 8, 2015

(54) CHILD RESISTANT CAP AND RELATED APPARAUTS AND METHOD

(71) Applicants: Stephen Elston, Ormond Beach, FL (US); Matthew Stephen Elston, Ormond Beach, FL (US)

(72) Inventors: Stephen Elston, Ormond Beach, FL (US); Matthew Stephen Elston, Ormond Beach, FL (US)

( * ) Notice: Subject to any disclaimer, the term of this patent is extended or adjusted under 35 U.S.C. 154(b) by 0 days.

(21) Appl. No.: 14/171,929

(22) Filed: Feb. 4, 2014

Related U.S. Application Data

(60) Provisional application No. 61/760,733, filed on Feb. 5, 2013.

(51) Int. Cl.
*B65D 50/04* (2006.01)

(52) U.S. Cl.
CPC ..... *B65D 50/04* (2013.01); *B65D 50/041* (2013.01)

(58) Field of Classification Search
CPC ..... B65D 50/04
USPC ..... 215/250, 316, 901, 201, 215; 222/541.7, 541.8; 220/256.1, 256, 220/254.1, 254.8
See application file for complete search history.

(56) References Cited

U.S. PATENT DOCUMENTS

| | | | | |
|---|---|---|---|---|
| 2,295,865 | A * | 9/1942 | Rentschler | 220/265 |
| 3,245,563 | A | 4/1966 | Tuuri | |
| 3,622,027 | A | 11/1971 | Maki | |
| 3,857,505 | A | 12/1974 | Mumford et al. | |
| 3,918,602 | A | 11/1975 | McIntosh | |
| 4,069,935 | A | 1/1978 | Hampel | |
| 4,319,690 | A | 3/1982 | Birrell et al. | |
| 4,632,264 | A | 12/1986 | Evans | |
| 4,666,063 | A | 5/1987 | Holoubek et al. | |
| 4,688,703 | A | 8/1987 | Bayer | |
| 4,773,548 | A | 9/1988 | Deussen | |
| 5,255,804 | A | 10/1993 | Butterbrodt | |
| 5,280,842 | A | 1/1994 | Koo | |
| 5,586,672 | A * | 12/1996 | Schneider et al. | 215/250 |
| 7,614,514 | B2 | 11/2009 | Fuchs | |
| 8,056,742 | B2 | 11/2011 | Brozell et al. | |
| 2006/0151417 | A1 * | 7/2006 | Fuchs | 215/256 |

* cited by examiner

*Primary Examiner* — Robert J Hicks
*Assistant Examiner* — Kareen Thomas
(74) *Attorney, Agent, or Firm* — Allen Dyer Doppelt Milbrath & Gilchrist

(57) ABSTRACT

A tamper resistant cap for a container includes an inner cap and an outer cap. The inner cap has a threaded inner surface, and an upper surface with a plurality of upwardly extending teeth. The outer cap houses the inner cap and defines a central bore thereabove with an inner engagement surface. On an intermediate layer of the outer cap, below the upper bore, there are a plurality of downwardly extending teeth. The tamper resistant cap is releasably securable onto a neck of the container by engagement with the threaded inner surface and removable therefrom by applying a downward force to the outer cap to mesh the upwardly and downwardly extending teeth. The central bore is engageable with a frangible post of the container to effect removal thereof.

17 Claims, 1 Drawing Sheet

CHILD RESISTANT CAP AND RELATED APPARAUTS AND METHOD

CROSS-REFERENCE TO RELATED APPLICATION

This application claims the benefit of U.S. Provisional Patent Application Ser. No. 61/760,733, the contents of which are herein incorporated by reference in their entirety.

FIELD OF THE INVENTION

The present invention relates to caps for containers, and more particularly, to child resistant caps.

BACKGROUND OF THE INVENTION

Many necessary household substances, such as medicines, cleaners, lubricants, adhesives and the like, can cause death or injury if used inappropriately. Such substances present a particular danger to small children, who not only lack the ability to read or otherwise differentiate containers of hazardous substances from toys and other safe objects, but also frequently insert objects into their mouths.

One way in which this problem has been addressed is via child-resistant container closures, such as child resistant caps. In the typical child resistant cap, some extra action beyond the normal opening motion is required to remove the cap. Often, the need for this extra action is not apparent from the exterior of the cap, unless you are able to read and follow printed instructions. While such child-resistant closures are helpful, further improvements are possible.

SUMMARY OF THE INVENTION

In view of the foregoing, it is an object of the present invention to provide an improved child resistant cap and related apparatus and methods. According to an aspect of the present invention, a child resistant cap further includes an engagement mechanism complementary with a frangible seal in a container opening.

According to an embodiment of the present invention, a tamper resistant cap for a container includes an inner cap and an outer cap. The inner cap has a threaded inner surface, and an upper surface with a plurality of upwardly extending teeth. The outer cap houses the inner cap and defines a central bore thereabove with an inner engagement surface. On an intermediate layer of the outer cap, below the upper bore, there is a plurality of downwardly extending teeth. The tamper resistant cap is releasably securable onto a neck of the container by engagement with the threaded inner surface and removable therefrom by applying a downward force to the outer cap to mesh the upwardly and downwardly extending teeth. The central bore is engageable with a frangible post of the container to effect removal thereof.

These and other objects, aspects and advantages of the present invention will be better appreciated in view of the drawings and following detailed description of preferred embodiments.

DETAILED DESCRIPTION OF PREFERRED EMBODIMENTS

Figures 1, 2, 3, 4, 5, 6:
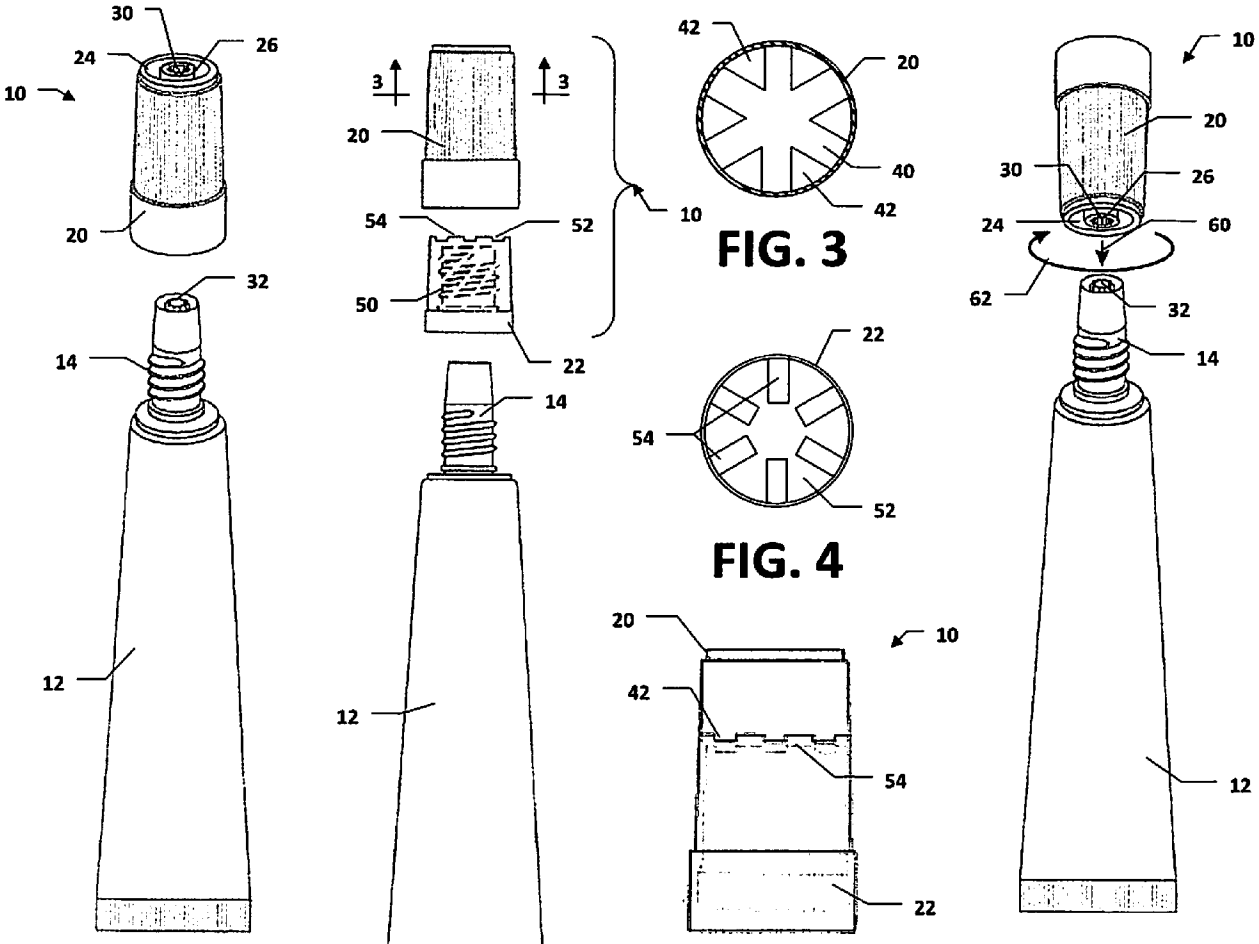
FIG. 1 is a perspective view of a child resistant cap for a container, according to an embodiment of the present invention.
FIG. 2 is a partially exploded side view of the child resistant cap of FIG. 1, including outer and inner caps with some internal features shown in broken lines, along with the container.
FIG. 3 is a sectional view of the outer cap, taken along line 3-3 of FIG. 2.
FIG. 4 is a top view of the inner cap of FIG. 2.
FIG. 5 is a side view of the inner and outer caps of FIG. 2, showing their internal engagement.
FIG. 6 is a perspective view of the child resistant cap of FIG. 1, reoriented to engage a frangible element of the container.

Referring to FIGS. 1 and 2, according to an embodiment a tamper resistant cap 10 is operable to seal and unseal a container 12, such as the depicted tube. More particularly, the tamper resistant cap 10 threads onto a neck 14 of the container 12. Once fully threaded onto the neck 14, the cap 10 will spin freely without unthreading unless sufficient downward force is applied to the cap 10. The cap 10 includes an outer cap 20 and an inner cap 22. The inner cap 22 is rotatably held in the outer cap 20, except when the sufficient downward force engages the outer cap 20 with the inner cap 22, allowing unthreading and removal of the cap 10.

The outer cap 20 defines an annular upper bore 24 extending downwards partially thereinto from a top surface (with reference to the orientation of FIGS. 1 and 2) thereof. The annular upper bore 24 surrounds a central post 26, which in turn defines a central bore 30. The central bore 30 is formed with an engagement surface (such as a multi-point star configuration) that is complementary with a frangible post 32 located in the neck 14, as will be explained in greater detail below.

Referring also to FIG. 3, the outer cap 20 has an intermediate layer 40 at the bottom of the annular bore 24. A plurality of downwardly extending teeth 42 are formed on a lower surface of the layer 40 for engagement with the inner cap 22.

Referring to FIGS. 2 and 4, the inner cap 22 includes inner threads 50 for threading onto the neck 14 of the container 12. An upper surface 52 of the inner cap 22 has teeth 54 extending upwardly therefrom.

Referring to FIG. 5, the teeth 42 of the outer cap 20 and the teeth 54 of the inner cap 22 will mesh when the outer cap 20 is pushed toward the inner cap 22 and turned. Without the application of pressure to urge the outer cap 20 toward the inner cap 22, rotation of the outer cap 20 will not result in rotation and unthreading of the inner cap 22.

Referring to FIG. 6, operation of the cap 10 to break and remove the frangible post 32 in the neck 14 will be explained. The cap 10 is inverted, such that its top is directed toward the neck 14. The annular upper bore 24 is inserted over an upper portion of the neck 14 (in the direction of arrow 60), with the central post 26 extending into the neck such that the central bore 30 closely engages the frangible post 32. The cap 10 is then rotated to break the frangible post 32 off. The cap 10 and post 32 are then removed, and the neck 14 is open and ready to dispense the contents of the container 12, subject to closure by the cap 10.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A container and cap combination comprising:

a container including:

a neck; and a frangible post within the neck and closing the container so as to prevent dispensing of contents thereof; and a tamper resistant cap including:

an inner cap, and an upper surface; and an outer cap housing the inner cap and defining a central bore thereabove;

wherein the tamper resistant cap is releasably securable onto the neck by engagement of the inner cap and the neck and removable therefrom only when applying a downward force to the outer cap to engage the inner cap, and the frangible post is removable from the neck by inverting the tamper resistant cap, placing the central bore over the frangible post and rotating the tamper resistant cap to break off the frangible post.

2. The combination of claim 1, wherein the container is a tube.

3. The combination of claim 1, wherein the neck has an outer threaded surface and the inner cap has an inner threaded surface complementary therewith.

4. The combination of claim 1, wherein the inner cap has an upper surface with a plurality of upwardly extending teeth, and the outer cap has an intermediate layer thereabove with a plurality of downwardly extending teeth, the upwardly and downwardly extending teeth meshing to cause rotation of the inner cap when the downward force is applied to the outer cap.

5. The combination of claim 1, wherein the frangible post has an outer engagement surface and the central bore has an inner engagement surface complementary therewith.

6. The combination of claim 5, wherein the outer and inner engagement surfaces have complementary multi-pointed star configurations.

7. The combination of claim 1, wherein the outer cap includes a central post in which the central bore is defined, and the outer cap further defines an annular upper bore surrounding the central post, such that an upper portion of the neck is received in the annular bore when the central bore engages the frangible post.

8. A tamper resistant cap for a container, the tamper resistant cap comprising:

an inner cap having a threaded inner surface, and an upper surface with a plurality of upwardly extending teeth; and an outer cap housing the inner cap and defining a central bore thereabove with an inner engagement surface, and an intermediate layer below the upper bore with a plurality of downwardly extending teeth;

wherein the tamper resistant cap is releasably securable onto a neck of the container by engagement with the threaded inner surface and removable therefrom by applying a downward force to the outer cap to mesh the upwardly and downwardly extending teeth, and the central bore is engageable with a frangible post of the container to effect removal thereof.

9. The tamper resistant cap of claim 8, wherein the outer cap includes a central post in which the central bore is defined, and the outer cap further defines an annular upper bore surrounding the central post, such that an upper portion of the neck is receivable in the annular bore with the central bore engaging the frangible post.

10. The tamper resistant cap of claim 8, wherein the inner engagement surface has a multi-pointed star configuration.

11. A method of opening a container, the method comprising:

inverting a cap over a container neck;

engaging a frangible post closing the container neck with a central bore defined in an upper surface of the cap; and rotating the cap to break off the frangible post;

wherein the cap includes an outer and an inner cap housed therein, the inner cap being initially threaded onto the container neck, the method further comprising:

applying a downward force to the outer cap to engage the inner cap; and applying a rotational force to the outer cap with the downward force applied to unthread the inner cap from the container neck.

12. The method of claim 11, wherein engaging the frangible post closing the container neck with the central bore includes engaging complementary engagement surfaces thereof.

13. The method of claim 11, wherein applying the downward force to the outer cap to engage the inner cap includes meshing downwardly extending teeth on a lower surface of an intermediate layer of the outer cap with upwardly extending teeth on an upper surface of the inner cap.

14. A tamper resistant cap for a container, the tamper resistant cap comprising:

an inner cap having a threaded inner surface, and an upper surface with a plurality of upwardly extending teeth; and an outer cap housing the inner cap and having a lower surface with a plurality of downwardly extending teeth;

wherein the tamper resistant cap is releasably securable onto a neck of the container by engagement with the threaded inner surface and removable therefrom by applying a downward force to the outer cap to mesh the upwardly and downwardly extending teeth;

wherein the outer cap further has a central bore thereabove with an inner engagement surface, the lower surface being located on an intermediate layer below the upper bore, the central bore being engageable with a frangible post of the container to effect removal thereof.

15. A container and cap combination comprising:

a container including:

a neck; and a frangible post within the neck and closing the container so as to prevent dispensing of contents thereof, the frangible post having an outer engagement surface; and a cap including:

an outer cap defining a central bore in an upper surface thereof with an inner engagement surface;

wherein the frangible post is removable from the neck by inverting the outer cap, placing the central bore over the frangible post to mate the outer and inner engagement surfaces and rotating the tamper resistant cap to break off the frangible post;

wherein the cap further includes an inner cap with an upper surface having a plurality of upwardly extending teeth, and the outer cap further has an intermediate layer below the upper bore with a plurality of downwardly extending teeth, and the tamper resistant cap is releasably securable onto the neck by engagement of the inner cap and the neck and removable therefrom only when applying a downward force to the outer cap to engage the inner cap.

16. The combination of claim 15, wherein the outer cap includes a central post in which the central bore is defined, and the outer cap further defines an annular upper bore surrounding the central post, such that an upper portion of the neck is received in the annular bore when the central bore engages the frangible post.

17. The combination of claim 15, wherein the neck and the inner cap have complementary threaded surfaces.

* * * * *